United States Patent [19]

Sturman

[11] Patent Number: 4,721,332

[45] Date of Patent: Jan. 26, 1988

[54] WINDOW LOCK

[75] Inventor: William S. Sturman, South Point, Ohio

[73] Assignee: Rollyson Aluminum Products, Incorporated, South Point, Ohio

[21] Appl. No.: 899,289

[22] Filed: Aug. 22, 1986

[51] Int. Cl.[4] ..... E05C 3/04

[52] U.S. Cl. ..... 292/128; 292/108

[58] Field of Search ..... 292/228, 244, DIG. 38, 292/DIG. 46, DIG. 47, 190, 108, 128, 121, 219, 1; 70/DIG. 6

[56] References Cited

U.S. PATENT DOCUMENTS

| | | | |
|---|---|---|---|
| 493,159 | 3/1893 | Gibson | 292/108 X |
| 724,466 | 4/1903 | Hannan et al. | 292/128 |
| 1,155,953 | 10/1915 | Morrow | 292/108 X |
| 1,686,417 | 10/1928 | Norman | 292/108 |
| 3,797,870 | 3/1974 | Beckman | 292/108 X |
| 4,424,993 | 1/1984 | Shelby et al. | 292/128 |
| 4,606,567 | 8/1986 | Kato et al. | 292/336.3 |

*Primary Examiner*—Richard E. Moore

*Attorney, Agent, or Firm*—Biebel, French & Nauman

[57] ABSTRACT

A window lock is disclosed for use with a window sash and cooperating frame to retain the sash in position. The sash includes first and second sash members connected at right angles, with the frame including a channel within which the sash is positioned for movement within the frame. The lock includes a latch having an elongated bar and a laterally-extending hook portion, the latch being connected to the second sash member for pivotal movement and extending in a direction normal to sash movement. Pivotal biasing force is applied to the latch in the direction of the hook portion such that the hook portion is normally disposed against an inner surface of the frame channel. An opening defined within the channel receives the hook portion upon positioning of the sash with respect to the frame to align the hook portion and the opening. The hook portion can be locked into engagement with the frame channel. The hook portion can also be locked away from the channel to prevent the hook portion from engaging the opening in the frame as the sash is moved.

5 Claims, 8 Drawing Figures

WINDOW LOCK

BACKGROUND OF THE INVENTION

The present invention relates generally to sash-type windows and, more particularly, to a locking device used to maintain the window sash in position with respect to the window frame.

One common type of window used in building structures is a horizontally operating window wherein a frame is mounted within the window opening about its periphery. A window sash, containing glass or other window material, is slidably mounted within the frame, and is horizontally movable along the frame for opening or closing of the window. Windows of this type are typically formed from aluminum extrusions or wood pieces, which are assembled to define the window frame and sash.

Often, it is desired to secure the movable sash in position with the frame. The most common case is where the window is locked into a closed position for security purposes, or simply to discourge opening of the window as where the building is air conditioned. However, it may also be desirable to lock the sash into an open position. For example, movement of the sash could be discouraged for security reasons, to assure ventilation, or to protect occupants such as children. Of course, similar concerns exist with respect to vertically operating sash-type windows.

What is needed, therefore, is a means of preventing or discouraging unwanted sliding movement of the window sash within the frame. Such a device should be reliable and easy to operate. It should also be inexpensive and simple to manufacture, as well as easy to install on or within the window assembly. The device should not require the use of specialized parts in the window assembly itself, or require significant modification to the window components. The device should be specifically adapted for horizontally operating windows, but should also be capable of use with vertically-operating windows.

SUMMARY OF THE INVENTION

In meeting the foregoing needs, the present invention provides a window lock for use in conjunction with a window sash in a cooperating frame. The lock is used to retain the sash in a desired open position. The sash includes first and second sash members connected at right angles, with the first member disposed parallel to the direction of window movement and the second member disposed normal thereto. The frame includes a channel which within the first sash member is positioned for retaining and guiding the sash during opening and closing movement within the frame.

The lock includes a latch having an elongated bar and a laterally extending hook portion. The latch is connected to the second sash member for pivotal movement along a normal to the direction of movement plane, with the hook portion extending along the plane at approximately a right angle to the second sash member. Means is provided for applying pivotal biasing force to the latch in the direction of the hook portion such that the hook portion is normally disposed against an inner surface of the channel of the frame. An opening is defined within the inner surface of the channel for receiving the hook portion upon positioning of the sash with respect to the frame to align the hook portion within the opening.

Means is also provided for securing the hook portion in its biased position toward the inner surface of the channel. Further means is provided for counteracting the biasing force to move and retain the hook portion away from the inner surface.

A latch housing may be connected to the second member, with the housing including a forward wall and a forward opening defined therethrough, and a rearward wall and a rearward opening defined therethrough. The forward and rearward openings are defined such that the latch passes therethrough and is pivotally connected to the second member within the housing.

The means for applying pivotal biasing force may include a spring disposed within the housing and is positioned against the latch for applying force thereto. The latch may be molded from a resilient material, and the spring may be molded integrally with the latch.

The means for securing the hook portion in its biased position may include a first tab pivotally connected to the housing and a catch means secured to the first tab for engaging the housing along the rearward opening to secure the tab in contact with the latch to pivotally move the latch to advance the hook portion.

The means for counteracting the biasing force may include a second tab pivotally connected to the housing and a catch means secured to the second tab for engaging the housing along the rearward opening to secure the tab in contact with the latch to retract the hook portion from the inner wall of the channel.

Accordingly, it is an object of the present invention to provide a window lock for use in conjunction with a window sash in a cooperating frame to retain the sash in position with respect to the frame; to provide such a lock which may be used in conjunction with a sash and frame of conventional design; to provide such a window lock which is particularly adapted for a horizontally movable sash, but which can also be used with a vertically movable sash; to provide such a window lock which can secure the sash in a variety of different open positions; to provide such a window lock which is particularly usable with a window sash and cooperating frame formed from aluminum extrusions; to provide such a lock which is of simple design and reliable; to provide such a lock which is inexpensive to manufacture and which may be connected to the window sash and frame without substantial modifications or alterations thereto.

Other objects and advantages of the present invention will be apparent from the following description, the accompanying drawings, and the appended claims.

DETAILED DESCRIPTION OF THE PREFERRED EMBODIMENT

Figure 1:
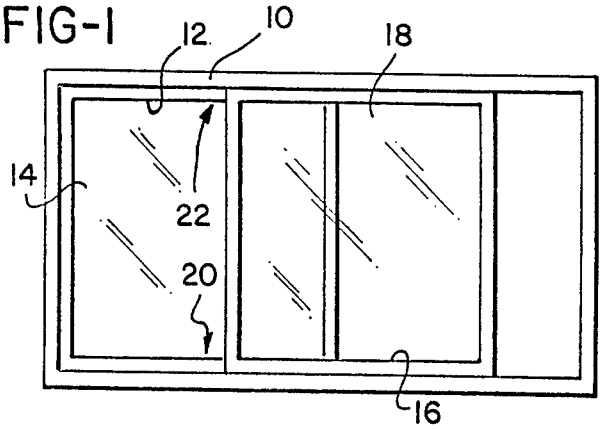
FIG. 1 is a plan view of a conventional window assembly of a type with which the lock of the present invention may be used.

A window of the general type with which the lock of the present invention may be used is shown in FIG. 1. A frame 10 extends around the interior surface of the window opening. Supported within the one portion of the frame 10 is a fixed sash 12 which supports a pane of glass or other window material 14. A movable sash 16 is slidably mounted within frame 10 in a conventional manner for selective horizontal opening or closing movement within the frame. Sash 16 supports a second pane 18 of glass or other material.

The lock device in accordance with the present invention may be used to retain the movable sash 16 in position with respect to frame 10. The lock device is mounted to the movable sash 16, and is preferably located at the lower corner 20 of sash 16. Alternatively, a lock may be located at the upper corner 22 of sash 16.

Figure 2:
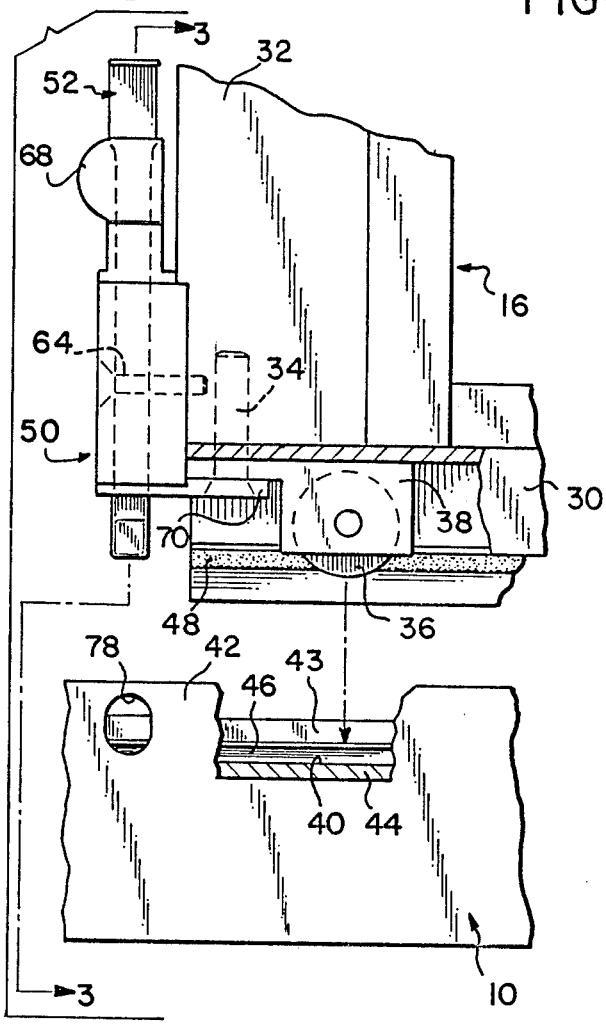
FIG. 2 is a plan view of a lower corner of a window sash and corresponding frame portion, with portions thereof broken away and with the sash moved away from the frame, showing the window lock attached to the sash.

A lock device and the lower corner of sash 16 may be seen in detail by reference to FIG. 2. Sash 16 includes a first, horizontal sash member 30 and a second, vertical sash member 32, both preferably formed as aluminum extrusions. Members 30 and 32 are positioned in mutual contact and at right angles to each other, with the horizontal member 30 connected to the vertical member 32 by a screw 34 extending into an internal channel (not shown) within member 32.

A cylindrical roller bearing 36 is mounted for rotation within a housing 38 in a known manner. (A second roller 36 (not shown) is mounted near the opposite lower corner of the window sash.) Housing 38 is secured to horizontal member 30 by screw 34.

Figure 3:
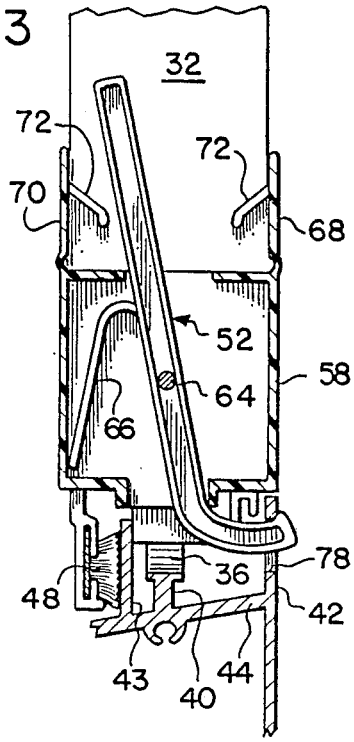
FIG. 3 is a view taken generally along line 3—3 in FIG. 2.

The sash 16 cooperates with frame 10 which includes an aluminum extrusion defining an internal channel 40. As best seen in FIG. 3, channel 40 is formed by an inner wall 42, and outer wall 43 and a base wall 44. A rail 46 extends from base wall 44, and provides a surface upon which cylindrical roller 36 rests after positioning of sash 16 within frame 10. As can be seen, the side walls of horizontal sash member 30 are disposed in close proximity to inner wall 42 and outer wall 43 of channel 40. A weather strip 48 is secured to a side wall of horizontal sash member 30, and is disposed in contact with outer wall 43 of channel 40, thereby providing a seal against outside air.

Figure 4:
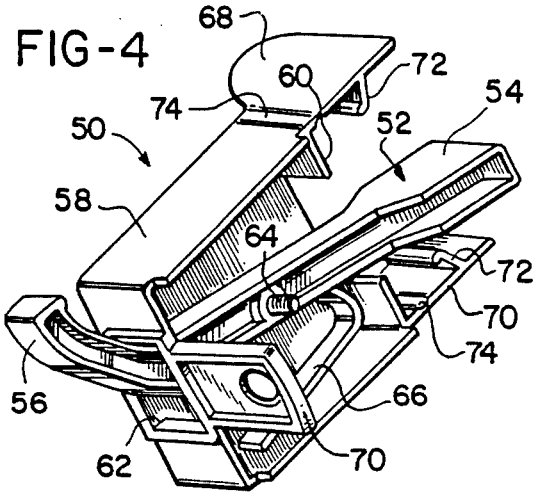
FIG. 4 is a three-quarter view of the window lock.

The lock mechanism itself can be seen by reference to FIG. 4. The lock mechanism 50 includes a latch 52 which includes an elongated bar 54 and a laterally extending hook portion 56 disposed at one end of bar 54. Latch 52 is located within a box-like housing 58 which includes an opening 60 in the upper or rear wall of housing 58 for permitting the rearward end of bar 54 to extend therethrough. Similarly, a lower or front opening 62 is provided in the lower or forward wall of housing 58, so that hook portion 56 of latch 52 may extend from housing 58. Latch 52 is pivotally secured with respect to housing 58 by a screw 64 passing through cooperating openings in both latch 52 and housing 58.

Latch 52 is preferably formed from a slightly resilient plastic material. Extending from one side of latch 52 is a curved spring member 66 which cooperates with a side wall of housing 58 to apply a biasing force to the latch to rotate the latch about screw 64 in a direction that advances hook portion 66.

A mounting projection 70 extends from housing 58 near opening 62. Projection 70 includes an opening through which screw 34 is passed, as shown in FIG. 2, to secure housing 58 to sash 16. In addition, screw 64, which passes through housing 58 and latch 52, extends into vertical member 32 to further secure lock assembly 50 to sash 16.

It should also be noted from FIGS. 2, 3 and 4 that projecting from the rearward side of housing 58 is a pair of lock tabs, including inner tab 68 and outer tab 70. Each tab includes a projecting catch 72 having a hooked end. Each tab 68 and 70 is attached to housing 58 by a unitary hinge portion 74 molded into the housing 58. Each tab 68 and 70 may be folded against the rear wall of housing 58, whereupon the corresponding catch 72 will engage the corresponding edge of opening 60, thereby retaining the tab 68 or 70 in place.

Figure 5:
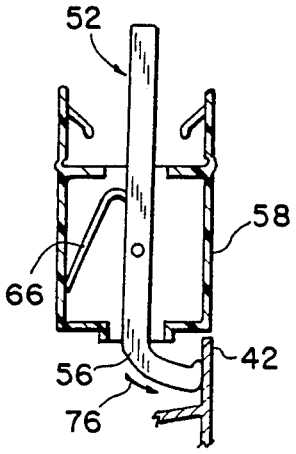
FIGS. 5–8 are partially schematic views similar to FIG. 3, showing various operating positions of the window lock.

The operation of the window lock for retaining the sash in position may be seen by reference to FIGS. 5–8. In FIG. 5, latch 52 is shown in its normal position within housing 58. Spring 66 biases latch 52 to pivot about screw 64, so as to move hook portion 56 against inner wall 42 of channel 40 within frame 10, as indicated by arrow 76. The biasing force applied by spring 66 is selected such that hook portion 56 is disposed against wall 42, but does not apply sufficient biasing force to interfere with the sliding movement of sash 16 along frame 10. In effect, the outer end of hook portion 56 rides along the surface of wall 42 as the sash is moved.

Referring back to FIG. 2, disposed along inner wall 42 of channel 40 is at least one opening 78 formed therethrough. Opening 78 is located in wall 42 so as to be in the path traversed by hook portion 56 during sliding movement of sash 16, and is further located so as to correspond with a desired position for window 16. It will be recognized that a plurality of openings 78 may be included, located at various positons along inner wall 42.

Figure 6:
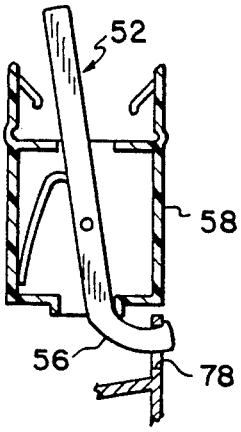

Referring now to FIG. 6, as window sash 16 is moved upwardly along frame 10, hook portion 56 of latch 52 moves along inner wall 42 until hook portion 56 approaches opening 78. The biasing action of spring 66 will then cause hook portion 56 to move into opening 78. Such engagement will preclude any further movement of sash 16, and sash 16 will remain locked in position.

To release sash 16 for further movement, the outer end of bar 54 of latch 52 is pivotally moved in a direction toward the operator. Such movement withdraws hook portion 56 from opening 78, whereupon sash 16 may be moved. After movement, and upon release of latch 52, hook portion 56 again moves to its normal position in contact with wall 42 of frame 10, as shown in FIG. 5.

Figure 7:
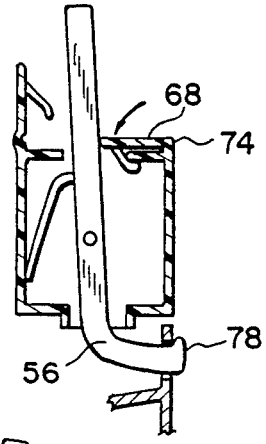
Figure 8:
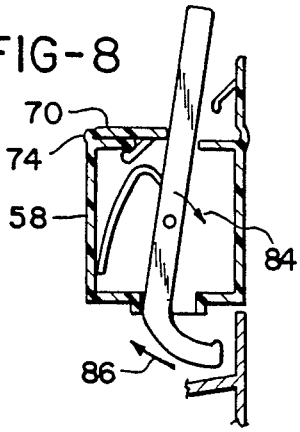

Sash 16 may be secured against unlatching of the lock assembly to discourage movement of sash 16 from a second position. As shown in FIG. 7, once hook portion 56 of latch 56 is engaged with opening 78, tab 68 is folded along hinge 74 toward the rear wall of housing 58. Catch 72 then engages with opening 60 in the rear wall of housing 58. The outer end of tab 68 extends partially into opening 60, and contacts bar 54 of latch 52. This prevents pivotal movement of latch 52 in a direction that would withdraw hook portion 56 from opening 78. Hook portion 56 is thereby secured in its biased position.

It may also be desired to disable the window lock to prevent hook portion 56 from automatically moving into an opening 78 as it moves past the opening during sliding movement of sash 16. In such a case, shown in FIG. 8, tab 70 is folded along hinge 74 against the rear wall of housing 58 such that catch 72 engages a side of opening 60 formed in the rearward wall. As with tab 68, tab 70 extends partially across opening 60, contacting latch 52 to move bar 54 in a pivotal direction as indicated generally by arrow 84. This in turn will move hook portion 56, as shown by arrow 86, out of contact with inner wall 42 of channel 40 of frame 10. By moving hook portion 56 out of such contact, it will not move into openings 78 as sash 16 is moved along frame 10.

While the window lock has been described in the context of a typical extruded-aluminum window environment, it should be recognized that the lock will be equally usable with other window arrangements. For example, the window lock may be used with a window sash and frame formed from wood rather than aluminum extrusion. In such a case, opening 78 may not be an opening completely through the frame, but rather a hole extending partially into the wood of the frame. In all other respects, however, the lock would operate in a manner identical to that described herein.

As a further alternative, the lock could be used with a window wherein the sash slides vertically within the frame. In such a case, the lock will function in a manner as described herein, but two identical assemblies may have to be used, positioned at each side of the sash. The lock assemblies may be locked at either the two lower or the two upper corners of the sash.

Still further alternative embodiments will be readily apparent to those skilled in the art.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A window lock for use in conjunction with a window sash and a cooperating frame to retain the sash in position with respect to the frame, said lock comprising:

a latch having an elongated bar and a laterally extending hook portion;

a latch housing including a forward wall having a forward opening defined therethrough, and a rearward wall disposed oppositely on said housing from said forward wall, said rearward wall defining a rearward opening therethrough;

said latch being connected to said latch housing for pivotal movement along a plane normal to said forward and said rearward walls, said elongated bar extending through said forward and said rearward openings, and said hook portion extending along said plane from said elongated bar outside said forward opening;

means for applying pivotal biasing force to said latch in the direction of said hook portion to bias said latch into a normal position;

means for selectively securing said latch in said normal position including a first tab pivotally connected to said housing and a first catch means secured to said first tab for engaging said housing along said rearward opening to secure said first tab in contact with said latch to prevent pivotal movement of said hook portion; and means connected to said housing for engaging said latch to selectively counteract said biasing force and retain said latch away from said normal position.

2. A window lock for use in conjunction with a window sash and a cooperating frame to retain the sash in position with respect to the frame, said lock comprising:

a latch having an elongated bar and a laterally extending hook portion;

a latch housing including a forward wall having a forward opening defined therethrough, and a rearward wall disposed oppositely on said housing from said forward wall, said rearward wall defining a rearward opening therethrough;

said latch being connected to said latch housing for pivotal movement along a plane normal to said forward and said rearward walls, said elongated bar extending through said forward and said rearward openings, and said hook portion extending along said plane from said elongated bar outside said forward opening;

means for applying pivotal biasing force to said latch in the direction of said hook portion to bias said latch into a normal position;

means connected to said housing for engaging said latch to selectively secure said latch in said normal position; and means for selectively counteracting said biasing force and retaining said latch away from said normal position including a second tab pivotally connected to said housing and a second catch means secured to said second tab for engaging said housing along said rearward opening to secure said second tab in contact with said latch to prevent pivotal movement of said hook portion.

3. A window lock for use in conjunction with a window sash and a cooperating frame to retain the sash in position with respect to the frame, said lock comprising:

a latch having an elongated bar and a laterally extending hook portion;

a latch housing including a forward wall having a forward opening defined therethrough, and a rearward wall disposed oppositely on said housing from said forward wall, said rearward wall defining a rearward opening therethrough;

said latch being connected to said latch housing for pivotal movement along a plane normal to said forward and said rearward walls, said elongated bar extending through said forward and said rearward openings, and said hook portion extending along said plane from said elongated bar outside said forward opening:

means for applying pivotal biasing force to said latch in the direction of said hook portion to bias said latch into a normal position;

means for selectively securing said latch in said normal position including a first tab pivotally connected to said housing and a first catch means secured to said first tab for engaging said housing along said rearward opening to secure said first tab in contact with said latch to prevent pivotal movement of said hook portion; and means for selectively counteracting said biasing force and retaining said latch away from said normal position including a second tab pivotally connected to said housing and a second catch means secured to said second tab for engaging said housing along said rearward opening to secure said second tab in contact with said latch to prevent pivotal movement of said hook portion.

4. A window lock as defined in claim 3, wherein said means for applying pivotal biasing force includes a spring disposed within said housing and is positioned against said latch for applying force thereto.

5. A window lock as defined in claim 4, wherein said latch is molded from a resilient material, and wherein said spring is molded integrally with said latch.

* * * * *